US011492242B2

(12) United States Patent
Caffa et al.

(10) Patent No.: US 11,492,242 B2
(45) Date of Patent: Nov. 8, 2022

(54) CAPPING HEAD FOR THE APPLICATION OF CAPS ON CONTAINERS OR BOTTLES

(71) Applicant: AROL S.P.A., Canelli (IT)

(72) Inventors: Marco Caffa, Cortemilia (IT); Marco Cipriani, Alpignano (IT)

(73) Assignee: AROL S.P.A., Canelli (IT)

( * ) Notice: Subject to any disclaimer, the term of this patent is extended or adjusted under 35 U.S.C. 154(b) by 224 days.

(21) Appl. No.: 16/341,990

(22) PCT Filed: Oct. 18, 2017

(86) PCT No.: PCT/IB2017/056474

§ 371 (c)(1),
(2) Date: Apr. 15, 2019

(87) PCT Pub. No.: WO2018/073761

PCT Pub. Date: Apr. 26, 2018

(65) Prior Publication Data

US 2019/0248636 A1 Aug. 15, 2019

(30) Foreign Application Priority Data

Oct. 21, 2016 (IT) ..... 102016000106100

(51) Int. Cl.
*B67B 3/20* (2006.01)
*B67B 3/26* (2006.01)

(52) U.S. Cl.
CPC ..... *B67B 3/2066* (2013.01); *B67B 3/2033* (2013.01); *B67B 3/268* (2013.01); *B67B 2201/08* (2013.01)

(58) Field of Classification Search
CPC ... B67B 3/2066; B67B 3/268; B67B 2201/08; B67B 2201/10; F16C 32/0423;
(Continued)

(56) References Cited

U.S. PATENT DOCUMENTS 5,842,322 A * 12/1998 Heudecker ..... B67B 3/10 53/319
7,334,380 B2 2/2008 Brunee
(Continued)

FOREIGN PATENT DOCUMENTS

| | | |
|---|---|---|
| CN | 103481056 A | 1/2014 |
| EP | 1424307 A1 | 6/2004 |
| EP | 2724976 A2 | 4/2014 |

OTHER PUBLICATIONS

CE.T.I.E., "Practical Guidelines for Bottling, Practical Guide No. 4, 26 mm Crown Cork Sealing", pp. 1-78, 2002 (month unknown).

*Primary Examiner* — Thanh K Truong
*Assistant Examiner* — Patrick B Fry
(74) *Attorney, Agent, or Firm* — Howson & Howson LLP

(57) ABSTRACT

A capping head for applying caps on containers or bottles and a capping assembly are provided. The capping head comprises a gripping assembly having a hollow body longitudinally extending along a vertical axis and internally defining a seat for the cap, the seat being delimited at its lower end by an inlet mouth for the introduction of the cap. A moving assembly is connected to the gripping assembly for controlling the movements thereof and is hermetically separated therefrom, and an ejector member is housed inside the hollow body of the gripping assembly, in such a manner that it is free to axially slide. The ejector member carries first and second magnetic elements such that a relative axial approach of the second magnetic element towards the first magnetic element results in a translation of the ejector member towards the lower inlet mouth of the gripping assembly.

13 Claims, 4 Drawing Sheets

(58) Field of Classification Search
CPC ..... H01H 36/0073; H01H 1/54; H01H 2001/545; H02K 49/102
USPC ..... 53/317; 335/207, 205
See application file for complete search history.

(56) References Cited

U.S. PATENT DOCUMENTS

| | | | | |
|---|---|---|---|---|
| 7,377,085 | B2 * | 5/2008 | Cirio | B67B 3/268 53/317 |
| 7,385,645 | B2 * | 6/2008 | Boon | G03B 17/08 348/373 |
| 8,258,902 | B2 * | 9/2012 | Lee | H01H 1/54 335/207 |
| 8,375,683 | B2 * | 2/2013 | Knieling | B67B 3/2086 53/317 |
| 8,400,240 | B2 * | 3/2013 | Pfeiffer | H01H 36/0073 335/205 |
| 9,388,032 | B2 * | 7/2016 | Singur | B67B 3/268 |
| 2005/0183388 | A1 | 8/2005 | Cirio | |
| 2010/0095636 | A1 * | 4/2010 | Cirio | B67B 3/2066 53/331.5 |
| 2013/0000251 | A1 | 1/2013 | Singur | |
| 2020/0007015 | A1 | 1/2020 | Cipriani | |
| 2020/0186020 | A1 | 1/2020 | Amerio et al. | |
| 2020/0048060 | A1 | 2/2020 | Caffa et al. | |
| 2020/0048061 | A1 | 2/2020 | Caffa et al. | |
| 2020/0087129 | A1 | 3/2020 | Caffa et al. | |

* cited by examiner

CAPPING HEAD FOR THE APPLICATION OF CAPS ON CONTAINERS OR BOTTLES

The present invention concerns a capping head for the application of caps on containers or bottles, as well as a capping assembly using at least one such head. More particularly, the present invention concerns a capping head for the application of caps on containers or bottles, equipped with ejection means which are particularly reliable and suitable to operate in aseptic conditions.

Capping heads are devices allowing tightly sealing a cap or plug on the mouth of containers or bottles, for instance of the kind intended for containing foodstuffs such as beverages. Such heads include, in known manner, an assembly for gripping a cap, which is moved by means of a moving assembly located axially above the gripping assembly. In general terms, the moving assembly includes a plurality of control mechanisms and the associated lubricating system enclosed within a casing.

Capping heads are generally employed in capping assemblies also referred to as "capping machines", which usually include a movable support moving a plurality of capping heads, generally mounted on the periphery of the same support, by following a path along which also the containers to be capped are conveyed and synchronously with the same containers.

While each capping head and the corresponding container positioned below the head are moving along the common path, the capping head, previously loaded with a cap kept in position by a gripping assembly, moves downwards, while possibly rotating the gripping assembly in order to screw the cap on the neck of the container, and then moves back to a lifted position.

If the cap application operation is not performed, e.g. because there is no underlying container or because of a misaligned positioning of the cap in the gripping assembly of the head preventing the proper cap application on the mouth of the container, it is necessary that such a cap is removed before the head returns to the position in which it takes a new cap in order to perform a new capping cycle on a new container.

To this end, the prior art capping heads are generally equipped with an ejection rod, which is mounted so as to be axially slidable through the assemblies forming the head and the axial position of which is controlled by a respective control drive, e.g. a mechanical cam drive, in which a roller connected to the rod is slidably constrained.

The Applicant has noticed that the provision of an ejection rod guided through the capping head may be a source of contamination between the gripping assembly located in the lower part of the head, kept in aseptic condition, and the above-lying moving assembly, through which assemblies the rod slides.

Actually, in order to comply with the cleanliness and hygienic safety rules required e.g. in the foodstuff field, it is necessary to keep the upper part isolated from the lower part, since, as said above, the former includes the various control mechanisms of the machine and the associated lubricating system.

In order to obviate the above drawback, it is known to use an ejector member, confined within the lower and outer portion only of the head, in place of the ejection rod passing through the moving assembly and coming out from the bottom thereof towards the gripping assembly. More particularly, a small cylinder is provided, which is housed within the cap receiving seat defined in the gripping assembly so as to be free to axially slide in such a seat and is connected to a circumferential outer flange surrounding the gripping assembly. When the cap is taken, it penetrates into the receiving seat and tends to axially lift the small cylinder jointly with the circumferential flange If the cap, when leaving the capping path, remains inside the receiving seat in the gripping assembly, whereby the outer flange is in a lifted position, the cap interacts with stop walls preventing it from being lifted together with the capping head. Such an interaction causes a lowering of the flange relative to the cap receiving seat and, consequently, a downward push exerted by the small cylinder on the cap present in such a seat, thereby ejecting the cap.

The Applicant has noticed that such a solution, even though it does not entail the risk of contamination between the moving assembly and the gripping assembly since the ejector member is wholly confined within the gripping assembly only, has however some drawbacks. Indeed, it compels to provide an abutment located along the capping path, with which the ejector can cooperate.

Moreover, the Applicant has also noticed that such a solution requires making a gripping assembly with a more complex structure, which must be suitable to house the small cylinder and to allow its connection with the outer flange.

Further, the Applicant has noticed that the overall weight and size of the gripping assembly surrounded by the outer flange is increased, so that the resulting structure has a considerably increased moment of inertia, thereby negatively affecting the performance at variable or high speed.

Still further, the Applicant has noticed that, when the cap is inserted in the receiving seat in the gripping assembly, the cylinder rests by gravity on the cap itself, thereby causing sometimes unwanted ejections during the capping path.

The problem to be solved by the present invention is therefore to provide a capping head which is equipped with a cap ejecting member capable of operating without contaminating the gripping assembly of the capping head and which at the same time is scarcely subjected to wear.

Within such a problem, it is an object of the present invention to conceive a capping head equipped with a cap ejecting member, which is characterised by a limited moment of inertia in case of rotation, while having at the same time a structure that is simple and compact and that can be produced at limited costs.

In particular, it is another object of the present invention to provide a capping head equipped with a cap ejecting member minimising the risk of unwanted ejections.

In accordance with a first aspect thereof, the invention concerns therefore a capping head for the application of caps on containers or bottles, comprising:

- a gripping assembly of a cap, comprising a hollow body longitudinally extending along a vertical axis and internally defining a receiving and retaining seat for the cap, the receiving and retaining seat being delimited at its lower end by an inlet mouth for the introduction of the cap;
- a moving assembly for the gripping assembly, connected to the gripping assembly for controlling the movements thereof and hermetically separated therefrom; and
- an ejector member housed inside the hollow body of the gripping assembly, in such a manner that it is free to axially slide;
- characterised in that the ejector member carries at least one first magnetic element suitable to magnetically interact with at least one second magnetic element having the same polarity placed outside the gripping assembly and at an axial height greater than the first magnetic element, such that a relative axial approach of the second magnetic element towards the first magnetic element results in a translation of the ejector member towards the lower inlet mouth of the gripping assembly.

The Applicant has realised that, by using a pair of magnetic elements with the same polarity located at different axial heights, it is possible to transfer an axial thrust without the need to bring the members to be moved in mutual contact. In this manner, it is advantageously possible to transfer the thrust on the cap to be ejected, without the ejector member housed within the sterile gripping assembly being acted upon by contact by an external member which could contaminate it.

Actually, through an axial approach of the first and the second element, a downward movement of the ejector member carrying the first magnetic element relative to the hollow body is obtained, which movement in turn determines a downward thrust against the cap and thus the ejection thereof, without any contact between the two magnetic elements. This results in considerable benefits in terms of lengthening of the life of the capping head, by reducing the wear and the creation of micro-powders.

As a further but not the last advantage, it is possible to make a capping head which has a simple structure and a compact size, and thus has a reduced moment of inertia, with a consequent improvement of the operating performance.

In accordance with a second aspect thereof, the invention concerns a capping assembly comprising a movable support structure for moving at least one capping head for the application of caps on containers or bottles along a conveying path of containers to be capped, comprising at least one capping head for the application of caps on containers or bottles as described above.

Advantageously, the capping assembly according to the invention attains the technical effects described above in connection with the capping head for the application of caps on containers or bottles.

The present invention may have at least one of the following preferred features, which can be in particular combined together at will in order to cope with specific application requirements.

Preferably, the second magnetic element is comprised inside the moving assembly and brought in axial translation along the axis by means of a moving member, between a position which is distal from the gripping assembly and a position which is proximal to the gripping assembly.

More preferably, the moving member is a rod vertically sliding along the axis and carrying at its lower end the second magnetic element.

Thanks to the arrangement of the second magnetic element inside the moving assembly, the capping head can be made with an overall compact size. Indeed, the need to provide outward projecting members intended to cooperate with abutments arranged along the capping path no longer exists. Consequently, such abutments can be eliminated, thereby further simplifying the system in the whole.

Preferably, the at least one first magnetic element is a permanent magnet placed above the ejector member and rigidly connected thereto.

Preferably, the gripping assembly comprises a suspension member made of magnetic material or of magnetisable material suitable for the magnetic interaction with the first magnetic element so as to determine a suspension condition of the ejector member.

In the present description and in the appended claims, the expression "magnetisable material" is intended to denote any material that, under the action of an external magnetic field, is capable of becoming polarised and possibly maintaining such polarisation in time. In general terms, ferromagnetic and paramagnetic materials are magnetisable materials.

In the present description and in the appended claims, the expression "suitable to (magnetically) interact only when in proximity" is intended to denote those magnetic couplings generating a sufficient attraction force to overcome the gravity force only when the interacting elements are in close proximity or in contact.

The Applicant has realised that, by using a suspension member magnetically cooperating with the first magnetic element, it is possible to attain a suspension condition of the ejector member when the latter, upon introduction of the cap into the receiving seat, is pushed upwards and brought in close proximity of the suspension member.

Actually, the Applicant has realised that, by using a suspension member capable of developing a sufficient attraction force to overcome the gravity force only in condition of substantial contact with the ejector member, it is possible to attain a magnetic suspension condition without however affecting the operation of the ejector member and altering it in the subsequent operation phases.

Advantageously, under such condition, the ejector member does not discharge its weight on the cap, thereby substantially eliminating the risk of accidental cap ejections during the capping path, and at the same time the ejecting action performed by the ejector member is not affected by the magnetic interaction.

Preferably, the suspension member is at least a portion of an inner wall of the hollow body.

More preferably, the suspension member is at least a portion of a wall extending orthogonally to the axis and delimiting the hollow body on the upper side.

Advantageously, in this manner, the orthogonal wall, besides acting as a suspension member for the ejector member, also implements an upper end stop for the axial sliding thereof.

Preferably, the ejector member is rigidly connected to a pin transversally engaging with a pair of longitudinal slots extending parallel to the axis and obtained in the side wall of the hollow body.

Preferably, the second magnetic element having the same polarity as the first magnetic element is mounted on at least one wall located along a perimeter of the movable support structure and preferably it projects from a lower surface of the at least one wall located along the perimeter of the movable support structure.

More preferably, the ejector member is rigidly connected to a circumferential flange mounted in an axially slidable manner outside the tubular body, the at least one first magnetic element being carried by the circumferential flange so as to project from the upper surface thereof.

Even more preferably, the at least one first magnetic element includes an annular magnet or a plurality of magnets having the same axial polarity, arranged in a ring-shaped configuration.

When the second magnetic element is located outside the head and is mounted on a wall located along a perimeter of the movable support structure, interaction with the gripping assembly advantageously takes place without contact, thereby affording considerable benefits in terms of lengthening of the life of the capping head. Actually, a considerable reduction of wear and of micro-powder creation is obtained in comparison with the prior art solution which provides for operating the ejector member through an interaction by contact between the flange to which the ejector is connected and the walls.

More preferably, the at least one second magnetic element includes a permanent magnet having an elongated and possibly curved shape, or a plurality of permanent magnets having the same axial polarity and arranged along a line or a portion of an arc.

More preferably, the at least one wall located along the perimeter of the support structure is inclined relative to a horizontal plane, and extends from an upper position to a lower position with reference to the direction of forward movement of the support structure.

Advantageously, the inclined arrangement allows generating a progressive force during ejection.

In the alternative, the at least one wall located along the perimeter of the support structure is arranged substantially parallel to a horizontal plane.

Preferably, the ejector member carries at least one third magnetic element suitable to magnetically interact with the suspension member in order to determine a suspension condition of the ejector member, the magnetic interaction between the third magnetic element and the suspension member being such as to determine the suspension condition only when the ejector member is brought in close proximity of or in contact with the suspension member.

Preferably, the at least one third magnetic element is at least one permanent magnet embedded in an outer wall of the ejector member and projects from the same wall.

More preferably, the at least one third magnetic element is at least one permanent magnet embedded in an upper outer wall of the ejector member and projects upwards from the same wall.

In the alternative, the at least one third magnetic element is at least one permanent magnet embedded in a side outer wall of the ejector member and laterally projects from the same wall.

Preferably, the at least one third magnetic element is at least one annular permanent magnet or includes a plurality of magnets having the same polarity and arranged in a ring-shaped configuration.

The different features in the individual configurations can be combined together at will according the preceding description, should the advantages specifically resulting from a particular combination have to be exploited.

In the drawings.

In the following description, for describing the Figures, the same reference numerals are used to denote constructive elements having the same functions. Moreover, for the sake of clarity of the illustration, it is possible that some reference numerals are not shown in all Figures.

Figure 1:
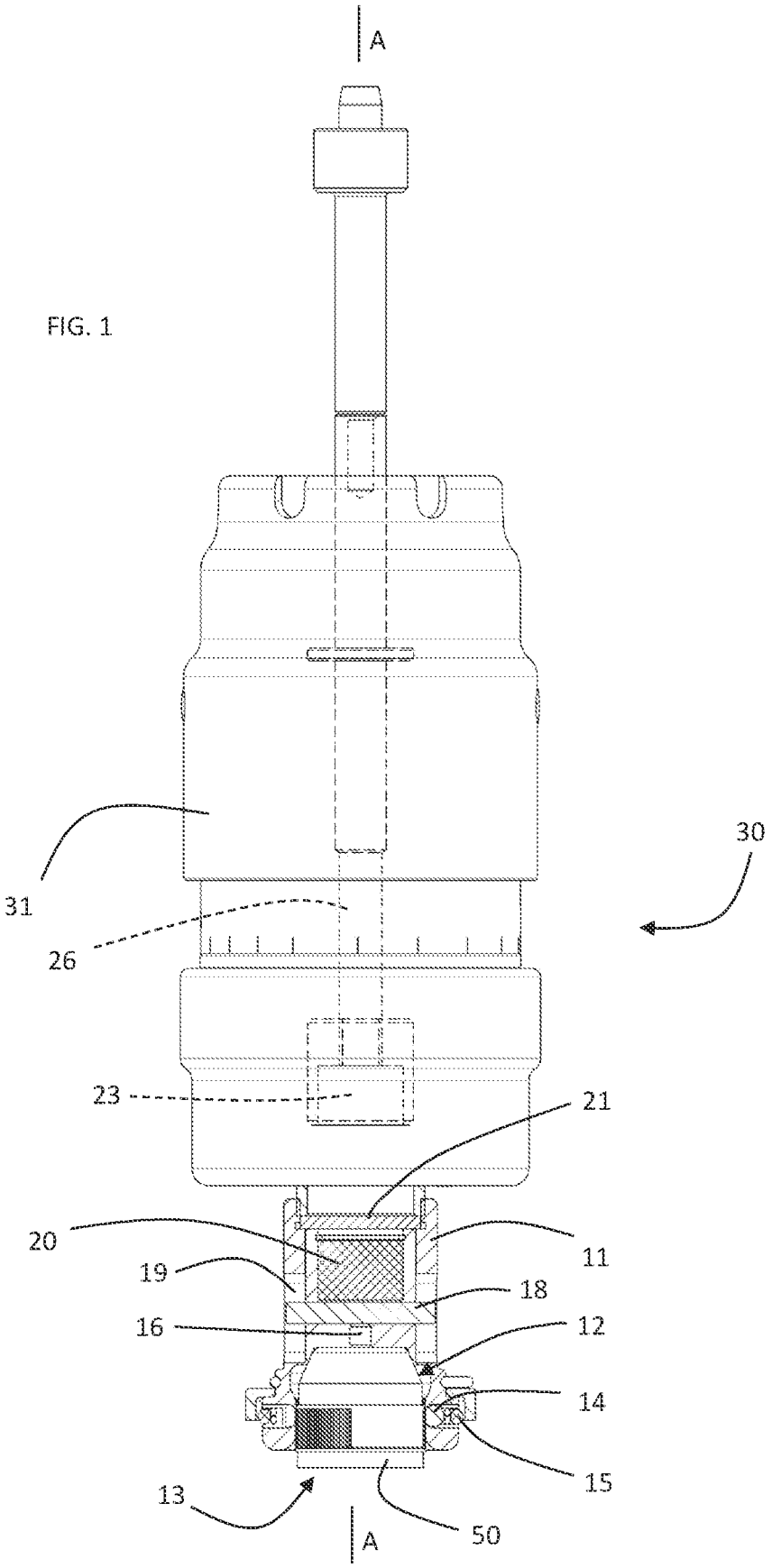
FIG. 1 is a side elevational view, partly in section, of a first embodiment of a capping head according to the present invention in a first operating condition of the members contributing to the cap ejection.
Figure 2:
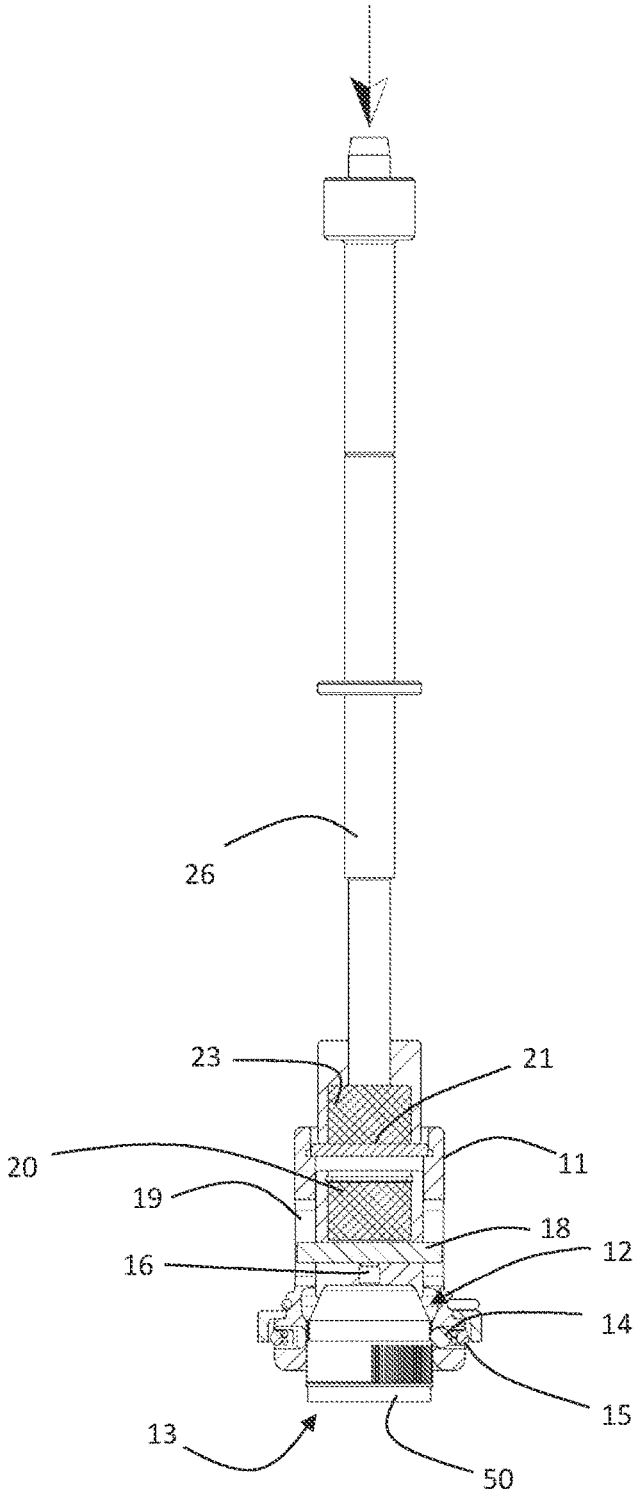
FIG. 2 is a side elevational view, partly in section, of the members contributing to the cap ejection in the capping head shown in FIG. 1, in a second operating condition.
Figure 3:
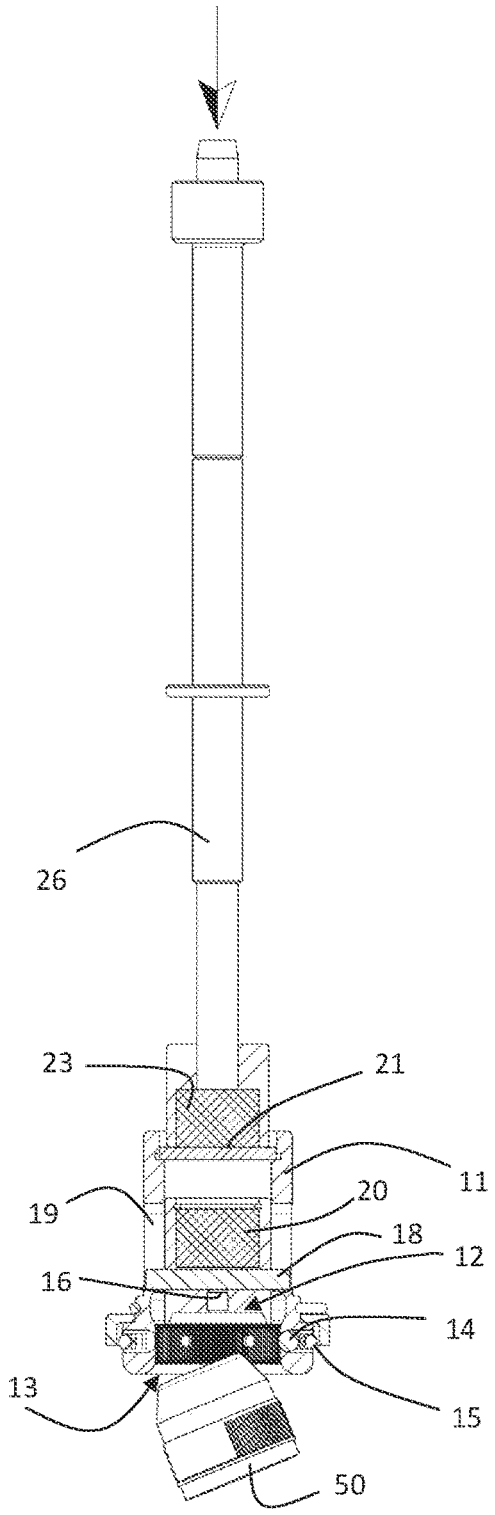
FIG. 3 is a side elevational view, partly in section, of the members contributing to the cap ejection in the capping head shown in FIG. 1, in a third operating condition.
Figure 6:
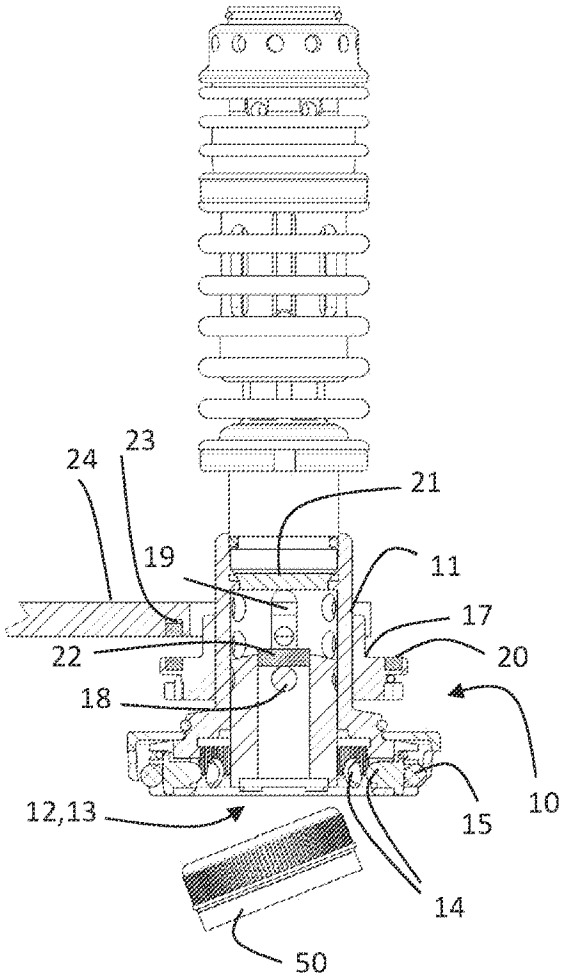
FIG. 6 is a partial second side elevational view, partly in section, of the gripping assembly shown in FIG. 4, at the end of the ejection step.
Figure 5:
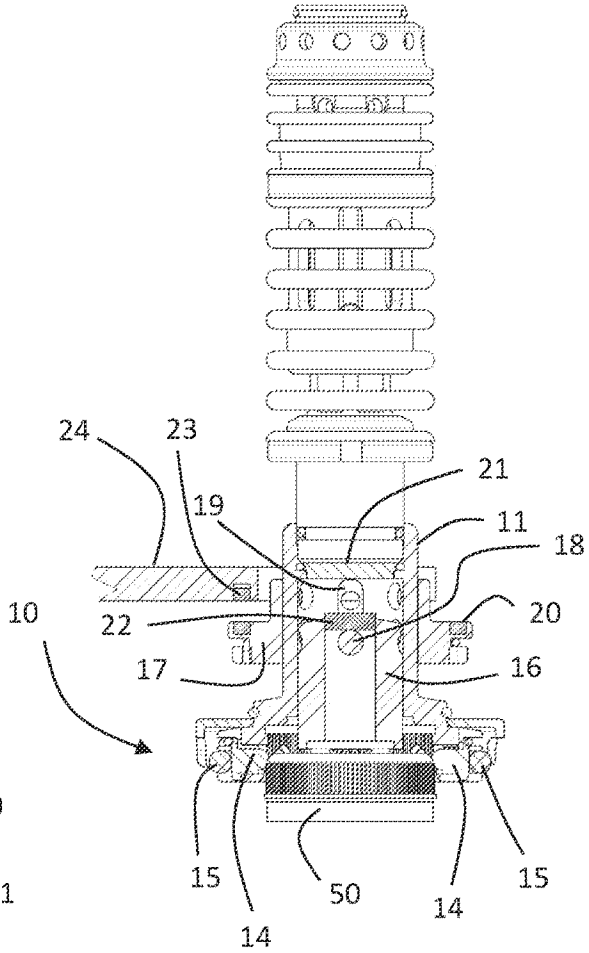
FIG. 5 is a second side elevational view, partly in section, of the gripping assembly shown in FIG. 4, at the beginning of the ejection step.
Figure 4:
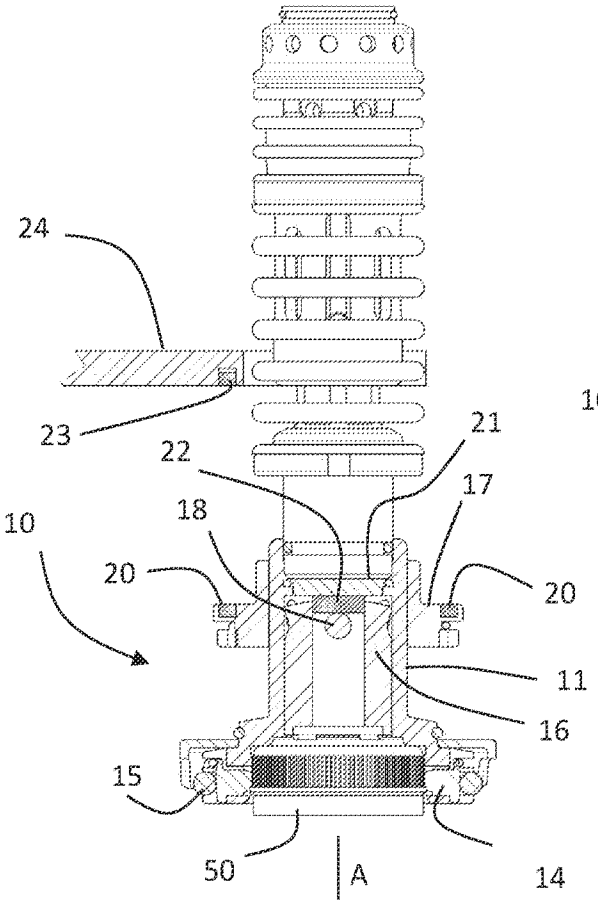
FIG. 4 is a first side elevational view, partly in section, of a gripping assembly of a second embodiment of a capping head according to the present invention, during the step of cap introduction into the receiving seat of the gripping assembly.
Figure 7:
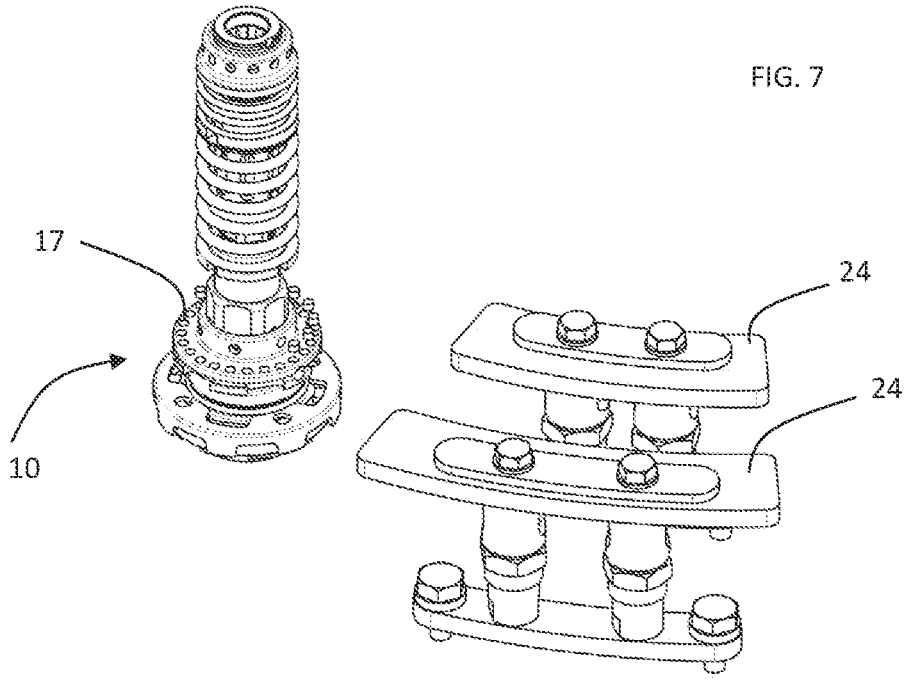
FIG. 7 is a perspective view of the gripping assembly shown in FIG. 4 in a step of approaching a pair of abutment walls with which the gripping assembly cooperates for performing cap ejection.

Referring to the Figures, there is shown a capping head 30 carrying at its bottom end a gripping assembly 10 for a cap 50, in which an ejector member 16, a first embodiment of which is shown in FIGS. 1 to 3, operates.

Gripping assembly 10 is moved (translated and/or rotated) by means of a moving assembly 31 included in capping head 30 and located above gripping assembly 10. Moving assembly 31 is not shown in detail since it can be made in any manner known in the art. Similarly, also the structure of capping assembly 100 on which capping head 30 shown in FIG. 1 is mounted is not shown in detail, since also such a structure can be made in any manner known in the art.

Figure 8:
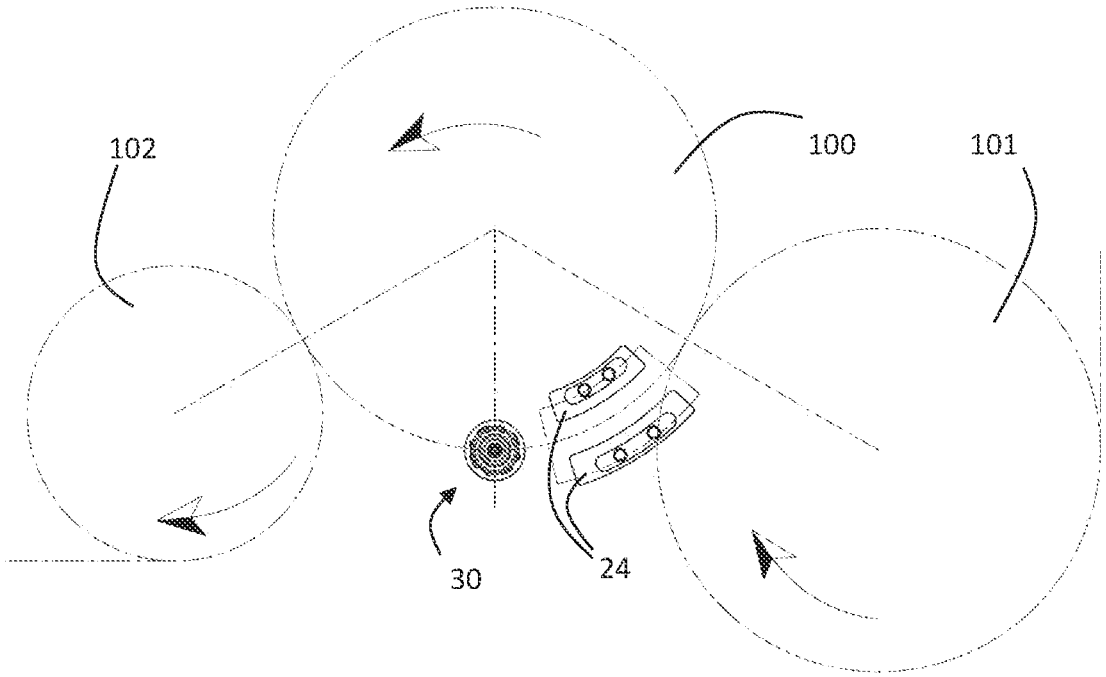
FIG. 8 is a schematic plan view of a capping assembly including a plurality of capping heads equipped with the gripping assembly shown in FIG. 4 and the abutment walls shown in FIG. 7.

In general terms, capping assemblies 100 typically have a carousel structure with a plurality of capping heads circumferentially moving along the carousel synchronously with respective supports for the containers, also mounted on a carrousel 101. Such a capping assembly 100 is schematically shown by way of example in FIG. 8.

At each turn of the carousel, each capping head 30 is axially displaced and is possibly made to rotate to perform the coupling (by insertion or by screwing) of a cap 50 on the mouth of a container (not shown).

During each operation cycle, each capping head 30 takes a respective cap 50 (in known manner) from a cap charger 102, it is lowered in order to apply cap 50 on the container mouth and then it is lifted again to an upper dead-point position where it is again ready to take a new cap 50.

Gripping assembly 10 shown in FIGS. 1 to 3 includes a tubular hollow body 11 internally defining a receiving and retaining seat 12 for cap 50. To this end, body 11 has a mouth 13 provided with means suitable to retain cap 50 through a positive or non-positive coupling (e.g. resiliently). In the example shown in the Figures, such retaining means include a plurality of balls 14 and a resilient ring 15 surrounding them and extending around tubular body 11. Balls 14 project through openings of the internal surface of seat 12 so that they are pressed against the side wall of cap 50 by resilient ring 15.

When capping head 30 is lowered on cap 50 carried by charger 102 in order to take the cap, cap 50 enters seat 12 by overcoming the action of resilient ring 15, and it is retained in such a seat due to the effect of the elastic reaction of ring 14 pushing balls 14 against the side wall of cap 50, An ejector member 16 is slidably mounted inside tubular body 11 of gripping assembly 10 and is housed within receiving seat for cap 50 so as to be free to axially translate along axis A of tubular body 11.

Ejector member 16 is rigidly connected to a diametrical pin 18 engaging with a pair of longitudinal slots 19 formed in the side wall of tubular body 11 and guiding the axial translatory movement of ejector member 16.

According to the present invention, a first magnetic element 20 is rigidly connected above ejector member 16. Moreover, a second magnetic element 23 is provided, which has the same axial polarity as the first magnetic element 20 and is made to approach the first element 20 from above so as to cause a downward translation thereof.

In the embodiment shown in FIGS. 1 to 3, the second magnetic element 23 having the same axial polarity is carried by a rod 26 housed inside moving assembly 31 of gripping assembly 10 and vertically slidable along axis A.

Advantageously, rod 26 is wholly housed inside moving assembly 31 of capping head 30 and its translatory movement is confined inside said assembly. In this manner, moving assembly 31 is hermetically separated from gripping assembly 10 by a wall 21 allowing isolating the aseptic lower part from the operating upper part.

When rod 26 is translated so as to approach partition 21, thereby making the second magnetic element 23 approach the first magnetic element 20 from above, as shown in FIGS. 2 and 3, magnetic repulsion between the first magnetic element 20 and the second magnetic element 23 having the same axial polarity causes ejector member 16 to be translated downwards, thereby determining a downward thrust action against cap 50 and consequently ejection thereof.

Referring to FIG. 3, when receiving and retaining seat 12 for cap 50 is empty, ejector member 16 is maintained by gravity in its lower end-stop position, closer to end mouth 13 of gripping assembly 10. When on the contrary a cap 50 is introduced into receiving and retaining seat 12, as shown in FIG. 1, ejector member 16 moves back to the position shown in that Figure. In such a position, the first magnetic element 20 is in contact with partition wall 21.

Advantageously, partition wall 21 is made of magnetisable material, so as to magnetically interact with the first magnetic element 20 carried by ejector member 16 and, when in contact therewith, to generate a sufficient attraction force to maintain a suspension configuration, whereby ejector member 16 does not discharge its weight on cap 50.

FIGS. 4 to 7 show a second embodiment of a gripping assembly 10 of a capping head according to the present invention.

Also gripping assembly 10 shown in FIGS. 4 to 7 includes a tubular hollow body 11 internally defining a receiving and retaining seat 12 for cap 50. A cylindrical ejector member 16 is slidably mounted inside tubular body 11 of gripping assembly 10. Ejector member 16 is confined inside receiving and retaining seat 12 for cap 50 so as to be free to axially translate along axis A of tubular body 11.

Ejector member 16 is rigidly connected to a circumferential flange 17 mounted in an axially slidable manner outside tubular body 11. Flange 17 is rigidly connected to internal ejector member 16 through a diametrical pin 18 engaging with a pair of longitudinal slots 19 formed in the side wall of tubular body 11.

According to the present invention, a plurality of first magnetic elements 20 are embedded in the rim of flange 17 and project from the upper surface of flange 17.

The plurality of first magnetic elements 20 cooperate with second magnetic elements 23 having the same axial polarity, which are mounted on a pair of horizontal walls 24 circumferentially located along the path of carousel capping assembly 100 immediately upstream, with reference to the movement direction of the carousel, the zone where a new cap 50 is taken at cap charger 102.

The second magnets 23 project from the lower surface of horizontal walls 24. When the first magnetic elements 20 are made to approach the second magnetic elements 23 from below, magnetic repulsion prevents circumferential flange 17 from approaching beyond a given limit distance, and hence from contacting the pair of horizontal walls 24.

Thus, a lifting of capping head 30 relative to horizontal walls 24 makes ejector member 16 remain at the same height, since flange 17 remains at a distance from said walls 24. This results in a downward movement of ejector member 16 relative to tubular body 11 carried by capping head 30, which movement in turn determines a downward thrust against cap 50 and thus ejection thereof.

Moreover, ejector member 16 carries on its upper side a third magnetic element 22, and a partition wall 21 arranged orthogonally to axis A and above ejector member 16 is provided in tubular body 11. Partition wall 21, besides allowing isolating the aseptic lower part from the operating upper part, acts as an upper end stop for the sliding movement of ejector member 16.

Advantageously, partition wall 21 is made of magnetisable material. In this manner, when a cap 50 is introduced into receiving and retaining seat 12, ejector member 16 moves back to the position shown in FIG. 4. In such a position, the third magnetic element 22 is in contact with partition wall 21, so as to magnetically interact with the same wall and to generate a sufficient attraction force to maintain a suspension configuration, whereby ejector member 16 does not discharge its weight on cap 50.

The features of the capping head for the application of caps on containers or bottles as well as of the corresponding capping assembly according to the present invention are clearly apparent from the above description, as are clearly apparent the relevant advantages.

Further variants of the embodiments described above are possible without departing from the teaching of the invention.

Lastly, it is clear that a capping head for the application of caps on containers or bottles as conceived is susceptible of several changes and modifications, all lying within the scope of the invention. Moreover all details can be replaced by technically equivalent elements. In the practice, any material as well any size can be employed depending on the technical requirements.

The invention claimed is:

1. A capping head (30) for the application of caps on containers or bottles, wherein said capping head (30) comprises:

a gripping assembly (10) for gripping a cap (50), wherein said gripping assembly (10) comprises a hollow body (11) longitudinally extending along a vertical axis (A) and internally defining a receiving and retaining seat (12) for the cap, the receiving and retaining seat (12) being delimited at its lower end by an inlet mouth (13) for the introduction of the cap (50);

a moving assembly (31) located in an operating upper part of the capping head connected to the gripping assembly (10) for controlling the translation and/or rotation movements of the gripping assembly (10) and hermetically separated from the gripping assembly (10) by a partition wall (21) allowing an isolation of an aseptic lower part of the capping head including the gripping assembly (10) from the operating upper part of the capping head; and an ejector member (16) housed inside the hollow body (11) of the gripping assembly (10), in such a manner that it is free to axially slide;

wherein the ejector member (16) carries at least one first magnetic element (20) suitable to magnetically interact with at least one second magnetic element (23) having the same polarity placed outside the gripping assembly (10) and at an axial height greater than the first magnetic element (20) such that a relative axial approach of the second magnetic element (23) towards the first magnetic element (20) results in a translation of the ejector member (16) towards the lower inlet mouth (13) of the gripping assembly (10); and wherein the partition wall (21) is arranged within the hollow body (11) orthogonally to the vertical axis (A) and above the ejector member (16) and is made of magnetic material or of a magnetizable material so as to define a corresponding suspension member suitable for the magnetic interaction with the first magnetic element (20) so as to determine a suspension condition of the ejector member (16), and wherein the partition wall (21), besides acting as a suspension member for the ejector member (16), also provides an upper end stop for the axial sliding of the ejector member (16).

2. The capping head (30) according to claim 1, wherein the second magnetic element (23) is comprised inside the moving assembly (31) and is brought in axial translation along the axis (A), by means of a moving member (26), between a position which is distal from the gripping assembly (10) and a position which is proximal to the gripping assembly (10).

3. The capping head (30) according to claim 2, wherein the moving member (26) is a rod vertically sliding along the axis (A) and carrying at its lower end the second magnetic element (23).

4. The capping head (30) according to claim 3, wherein the at least one first magnetic element (20) is a permanent magnet placed above the ejector member (16) and rigidly connected thereto.

5. The capping head (30) according to claim 4, wherein the ejector member (16) is rigidly connected to a pin (18) transversally engaging with a pair of longitudinal slots (19) extending parallel to the axis (A) and obtained in the side wall of the hollow body (11).

6. The capping head (30) according to claim 3, wherein the ejector member (16) is rigidly connected to a pin (18) transversally engaging with a pair of longitudinal slots (19) extending parallel to the axis (A) and obtained in the side wall of the hollow body (11).

7. The capping head (30) according to claim 2, wherein the at least one first magnetic element (20) is a permanent magnet placed above the ejector member (16) and rigidly connected thereto.

8. The capping head (30) according to claim 2, wherein the ejector member (16) is rigidly connected to a pin (18) transversally engaging with a pair of longitudinal slots (19) extending parallel to the axis (A) and obtained in the side wall of the hollow body (11).

9. The capping head (30) according to claim 1, wherein the at least one first magnetic element (20) is a permanent magnet placed above the ejector member (16) and rigidly connected thereto.

10. The capping head (30) according to claim 1, wherein the suspension member (21) is at least one inner wall portion of the hollow body (11).

11. The capping head (30) according to claim 10, wherein the ejector member (16) is rigidly connected to a pin (18) transversally engaging with a pair of longitudinal slots (19) extending parallel to the axis (A) and obtained in the side wall of the hollow body (11).

12. The capping head (30) according to claim 1, wherein the ejector member (16) is rigidly connected to a pin (18) transversally engaging with a pair of longitudinal slots (19) extending parallel to the axis (A) and obtained in the side wall of the hollow body (11).

13. A capping assembly (100) comprising a movable support structure for moving at least one capping head (30) for the application of caps (50) on containers or bottles along a conveying path of containers to be capped, the capping assembly comprising at least one capping head (30) for the application of caps on containers or bottles according to claim 1.

* * * * *